US009963262B2

(12) United States Patent
Smalley

(10) Patent No.: US 9,963,262 B2
(45) Date of Patent: May 8, 2018

(54) CARTON FOR ARTICLES

(71) Applicant: Graphic Packaging International, Inc., Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 113 days.

(21) Appl. No.: 14/923,636

(22) Filed: Oct. 27, 2015

(65) Prior Publication Data

US 2016/0114933 A1 Apr. 28, 2016

Related U.S. Application Data

(60) Provisional application No. 62/122,696, filed on Oct. 27, 2014.

(51) Int. Cl.
*B65D 65/00* (2006.01)
*B65D 75/00* (2006.01)
(Continued)

(52) U.S. Cl.
CPC ..... *B65D 5/4208* (2013.01); *B65D 5/0227* (2013.01); *B65D 5/2014* (2013.01);
(Continued)

(58) Field of Classification Search
CPC ..... B65D 5/4208; B65D 5/0227; B65D 5/46064; B65D 5/46192; B65D 2571/0066; B65D 5/4608; B65D 5/548048; B65D 5/2014; B65D 5/2038; B65D 5/4266; B65D 5/5425; B65D 71/40; B65D 2571/00271; B65D 2571/00438; B65D 2571/00561
(Continued)

(56) References Cited

U.S. PATENT DOCUMENTS 1,253,193 A 1/1918 Hill
2,196,502 A 4/1940 Kells
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2015/057472 dated Jan. 7, 2016.

*Primary Examiner* — J. Gregory Pickett
*Assistant Examiner* — Rafael Ortiz
(74) *Attorney, Agent, or Firm* — Womble Bond Dickinson (US) LLP

(57) ABSTRACT

A carton for holding a plurality of containers. The carton includes a plurality of panels that extends at least partially around an interior of the carton. The plurality of panels includes a front panel, a back panel, a bottom panel, and at least one top panel. The carton includes a plurality of end flaps each respectively foldably connected to a respective panel of the plurality of panels for at least partially closing an end of the carton. The carton further includes a handle having a handle opening in at least one of the front panel and the back panel, and a handle reinforcement flap foldably connected to the at least one top panel.

31 Claims, 7 Drawing Sheets

(51) Int. Cl.

| | |
|---|---|
| ***B65D 5/42*** | (2006.01) |
| ***B65D 5/02*** | (2006.01) |
| ***B65D 5/20*** | (2006.01) |
| ***B65D 5/54*** | (2006.01) |
| ***B65D 71/40*** | (2006.01) |

(52) U.S. Cl.

CPC ..... *B65D 5/2038* (2013.01); *B65D 5/4266* (2013.01); *B65D 5/5425* (2013.01); *B65D 71/40* (2013.01); *B65D 2571/0066* (2013.01); *B65D 2571/0079* (2013.01); *B65D 2571/00141* (2013.01); *B65D 2571/00271* (2013.01); *B65D 2571/00438* (2013.01); *B65D 2571/00561* (2013.01)

(58) Field of Classification Search

USPC ..... 206/427, 175, 434, 430, 431; 229/117.09, 199, 117.14, 117.12, 117.13, 229/117.16, 103.3, 122.3, 166

See application file for complete search history.

(56) References Cited

U.S. PATENT DOCUMENTS 2,308,050 A 1/1943 Burr
2,312,598 A * 3/1943 Sprague ..... B65D 5/4608 229/117.16
2,383,183 A 8/1945 Fischer
2,386,905 A 10/1945 Meitzen
2,568,204 A 9/1951 Reeser
2,594,376 A 4/1952 Arneson
2,645,405 A 7/1953 Dorfman
2,648,484 A 8/1953 Belsinger
2,702,144 A 2/1955 Forrer
2,702,155 A 2/1955 Baumann
2,797,856 A 7/1957 Jaeschke
2,810,506 A 10/1957 Kessler
2,868,433 A 1/1959 Anderson, Jr.
2,900,123 A 8/1959 Drnec et al.
2,955,739 A 10/1960 Collura
3,094,268 A 6/1963 Swanson et al.
3,112,856 A 12/1963 MacIntosh et al.
3,127,720 A 4/1964 Gentry et al.
3,173,596 A 3/1965 Aust et al.
3,204,815 A 9/1965 Weiss
3,309,005 A 3/1967 Pilger
3,334,767 A 8/1967 Cornelius et al.
3,355,012 A 11/1967 Weiss
3,381,881 A 5/1968 Granz et al.
3,756,499 A 9/1973 Giebel et al.
3,828,926 A 8/1974 Rossi
3,886,901 A 6/1975 Zeitter
3,904,036 A 9/1975 Forrer
3,927,822 A 12/1975 Giebel
3,933,303 A 1/1976 Kirby, Jr.
3,994,432 A 11/1976 Kirby, Jr.
4,005,815 A 2/1977 Nerenberg et al.
4,029,204 A 6/1977 Manizza
4,036,423 A 7/1977 Gordon
4,096,985 A 6/1978 Wood
4,111,306 A 9/1978 Roccaforte
4,165,031 A 8/1979 Osborne
4,216,861 A 8/1980 Oliff
4,318,474 A 3/1982 Hasegawa
4,326,633 A 4/1982 Schillinger et al.
4,328,923 A 5/1982 Graser
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,588,084 A 5/1986 Holley, Jr.
4,621,766 A 11/1986 McClure
4,653,686 A 3/1987 Wood et al.
4,679,726 A 7/1987 Oliff
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,333,734 A 8/1994 Stout et al.
5,350,109 A 9/1994 Brown et al.
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,472,090 A 12/1995 Sutherland
5,472,136 A 12/1995 Roccaforte
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,588,585 A 12/1996 McClure
5,593,027 A 1/1997 Sutherland
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,131,803 A 10/2000 Oliff et al.
6,164,526 A 12/2000 Dalvey
6,170,741 B1 1/2001 Skolik et al.
6,202,920 B1 * 3/2001 Auclair ..... B65D 5/18 229/103.2
6,227,367 B1 5/2001 Harrelson et al.
6,250,542 B1 6/2001 Negelen

(56) References Cited

U.S. PATENT DOCUMENTS

| | | | | |
|---|---|---|---|---|
| 6,260,755 | B1 | 7/2001 | Bates et al. | |
| 6,273,330 | B1 | 8/2001 | Oliff et al. | |
| 6,302,320 | B1 | 10/2001 | Stout | |
| D452,154 | S | 12/2001 | Rhodes et al. | |
| 6,425,520 | B1 | 7/2002 | Peterson | |
| 6,523,739 | B2 | 2/2003 | Heeley et al. | |
| 6,595,411 | B2 | 7/2003 | McClure | |
| 6,631,803 | B2 | 10/2003 | Rhodes et al. | |
| 6,758,337 | B2 | 7/2004 | Chargueraud et al. | |
| 6,766,940 | B2 | 7/2004 | Negelen | |
| 6,834,793 | B2 | 12/2004 | Sutherland | |
| 6,848,573 | B2 | 2/2005 | Gould et al. | |
| 6,869,009 | B2 | 3/2005 | Sutherland et al. | |
| 6,899,221 | B2 | 5/2005 | Skolik et al. | |
| 6,905,066 | B2 | 6/2005 | Holley et al. | |
| 6,926,193 | B2 | 8/2005 | Smalley | |
| 6,945,450 | B2 | 9/2005 | Rusnock | |
| 6,968,992 | B2 | 11/2005 | Schuster | |
| 7,234,596 | B2 | 6/2007 | Lebras | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,472,791 | B2 | 1/2009 | Spivey, Sr. | |
| 7,601,111 | B2 | 10/2009 | Sutherland et al. | |
| 7,614,497 | B2 | 11/2009 | Spivey, Sr. | |
| 7,699,215 | B2 | 4/2010 | Spivey, Sr. | |
| 7,703,666 | B2 | 4/2010 | Hand et al. | |
| 7,743,944 | B2 | 6/2010 | Ho Fung et al. | |
| 7,743,970 | B2 | 6/2010 | Bates et al. | |
| 7,748,603 | B2 | 7/2010 | Fogle et al. | |
| 7,757,933 | B2 | 7/2010 | Dunn | |
| 7,762,395 | B2 * | 7/2010 | Sutherland | B65D 71/16 206/147 |
| 7,775,418 | B2 | 8/2010 | Walling | |
| 7,780,003 | B2 | 8/2010 | Harrelson | |
| 7,780,067 | B2 | 8/2010 | Holley, Jr. | |
| 7,806,314 | B2 | 10/2010 | Sutherland | |
| 7,815,097 | B2 | 10/2010 | Fogle et al. | |
| 7,832,622 | B2 | 11/2010 | Spivey, Sr. | |
| 7,854,371 | B2 | 12/2010 | Mittelstaedt | |
| 7,900,816 | B2 | 3/2011 | Kastanek et al. | |
| 7,959,062 | B2 | 6/2011 | Auclair | |
| 7,984,843 | B2 | 7/2011 | Cooper et al. | |
| 7,998,047 | B2 | 8/2011 | Spivey, Sr. et al. | |
| 8,070,052 | B2 | 12/2011 | Spivey, Sr. et al. | |
| 8,186,569 | B2 | 5/2012 | Kelly | |
| 8,191,761 | B2 | 6/2012 | Brand | |
| 8,216,118 | B2 | 7/2012 | Dunn | |
| 8,256,617 | B2 * | 9/2012 | Gomes | B65D 71/48 206/147 |
| 8,302,811 | B2 | 11/2012 | Spivey | |
| 8,356,743 | B2 | 1/2013 | Spivey, Sr. | |
| 8,602,292 | B2 | 12/2013 | Brand | |
| 8,783,550 | B2 | 7/2014 | Schuster | |
| 9,033,210 | B2 | 5/2015 | Kastanek | |
| 9,187,206 | B2 | 11/2015 | Holley, Jr. | |
| 2002/0079356 | A1 | 6/2002 | Chargueraud | |
| 2003/0213263 | A1 | 11/2003 | Woog | |
| 2004/0074954 | A1 | 4/2004 | Fogle et al. | |
| 2005/0056658 | A1 | 3/2005 | Spivey | |
| 2005/0087592 | A1 | 4/2005 | Schuster | |
| 2005/0167478 | A1 | 8/2005 | Holley, Jr. | |
| 2005/0189405 | A1 | 9/2005 | Gomes et al. | |
| 2005/0263574 | A1 | 12/2005 | Schuster | |
| 2006/0071058 | A1 | 4/2006 | Spivey, Sr. | |
| 2006/0081691 | A1 | 4/2006 | Smalley | |
| 2006/0169755 | A1 | 8/2006 | Spivey, Sr. | |
| 2006/0273143 | A1 | 12/2006 | Finch | |
| 2006/0278689 | A1 | 12/2006 | Boshinski et al. | |
| 2007/0029220 | A1 * | 2/2007 | Bradford | B25J 7/00 206/427 |
| 2007/0039846 | A1 | 2/2007 | Spivey, Sr. | |
| 2007/0051781 | A1 | 3/2007 | Holley, Jr. | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0083820 | A1 | 4/2008 | Walling et al. | |
| 2008/0110967 | A1 | 5/2008 | Walling | |
| 2008/0119344 | A1 | 5/2008 | Sutherland et al. | |
| 2008/0128479 | A1 | 6/2008 | Bates et al. | |
| 2008/0203143 | A1 | 8/2008 | Holley | |
| 2008/0257943 | A1 | 10/2008 | Blin | |
| 2009/0212095 | A1 | 8/2009 | Auclair | |
| 2009/0236408 | A1 | 9/2009 | Spivey, Sr. | |
| 2009/0255983 | A1 | 10/2009 | De Paula et al. | |
| 2010/0025457 | A1 | 2/2010 | Cooper et al. | |
| 2010/0044420 | A1 | 2/2010 | Brand | |
| 2010/0213249 | A1 | 8/2010 | Requena | |
| 2011/0233091 | A1 * | 9/2011 | Block | B65D 5/0227 206/427 |
| 2011/0240725 | A1 | 10/2011 | Spivey et al. | |
| 2011/0284624 | A1 | 11/2011 | DeBusk et al. | |
| 2012/0012600 | A1 | 1/2012 | Gonzalez | |
| 2012/0067755 | A1 | 3/2012 | Spivey, Sr. | |
| 2012/0091021 | A1 | 4/2012 | Smalley | |
| 2013/0001236 | A1 * | 1/2013 | Block | B65D 5/443 220/654 |
| 2013/0092725 | A1 | 4/2013 | Kastanek | |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 2004 018 649 | 4/2005 |
| EP | 0 412 226 | 2/1991 |
| EP | 0 473 266 | 3/1992 |
| EP | 0870688 | 10/1998 |
| EP | 1 612 157 | 1/2006 |
| FR | 1 494 239 | 9/1967 |
| FR | 2 579 175 | 9/1986 |
| JP | 03039805 | 3/2000 |
| KR | 20-0356729 | 7/2004 |
| WO | WO 96/27538 | 9/1996 |
| WO | WO 99/28198 | 6/1999 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2006/135918 | 12/2006 |
| WO | WO 2007/089282 | 8/2007 |
| WO | WO 2008/027954 | 3/2008 |
| WO | WO 2008/036754 | 3/2008 |

* cited by examiner

CARTON FOR ARTICLES

CROSS-REFERENCE TO RELATED APPLICATION

This application claims the benefit of U.S. Provisional Patent Application No. 62/122,696, filed Oct. 27, 2014.

INCORPORATION BY REFERENCE

The disclosure of U.S. Provisional Patent Application No. 62/122,696, which was filed on Oct. 27, 2014, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having a handle.

SUMMARY OF THE DISCLOSURE

In general, one aspect of the disclosure is directed to a carton for holding a plurality of containers. The carton includes a plurality of panels that extends at least partially around an interior of the carton. The plurality of panels includes a front panel, a back panel, a bottom panel, and at least one top panel. The carton includes a plurality of end flaps each respectively foldably connected to a respective panel of the plurality of panels for at least partially closing an end of the carton. The carton further includes a handle having a handle opening in at least one of the front panel and the back panel, and a handle reinforcement flap foldably connected to the at least one top panel.

In another aspect, the disclosure is generally directed to a blank for forming a carton for holding a plurality of containers. The blank includes a plurality of panels comprising a front panel, a back panel, a bottom panel, and at least one top panel. The blank includes a plurality of end flaps each respectively foldably connected to a respective panel of the plurality of panels for at least partially closing an end of the carton formed from the blank. The blank further includes handle features for forming a handle. The handle features include a handle opening in at least one of the front panel and the back panel, and a handle reinforcement flap foldably connected to the at least one top panel.

In another aspect, the disclosure is generally directed to a method of forming the carton. The method includes obtaining a blank having a plurality of panels including a front panel, a back panel, a bottom panel, and at least one top panel. The blank includes a plurality of end flaps each respectively foldably connected to a respective panel of the plurality of panels. The blank further includes handle features comprising a handle opening in the back panel and a handle reinforcement flap foldably connected to the at least one top panel. The method includes forming an interior of the carton by positioning the plurality of panels and inserting a plurality of containers into the interior of the carton. The method includes overlapping the plurality of end flaps to at least partially form a closed end of the carton. The method further includes forming a handle in the back panel from the handle features by folding the handle reinforcement flap into face-to-face contact with the back panel above the handle flap to reinforce and strengthen the handle to prevent tearing of the carton when force is applied to the handle.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

Figure 1:
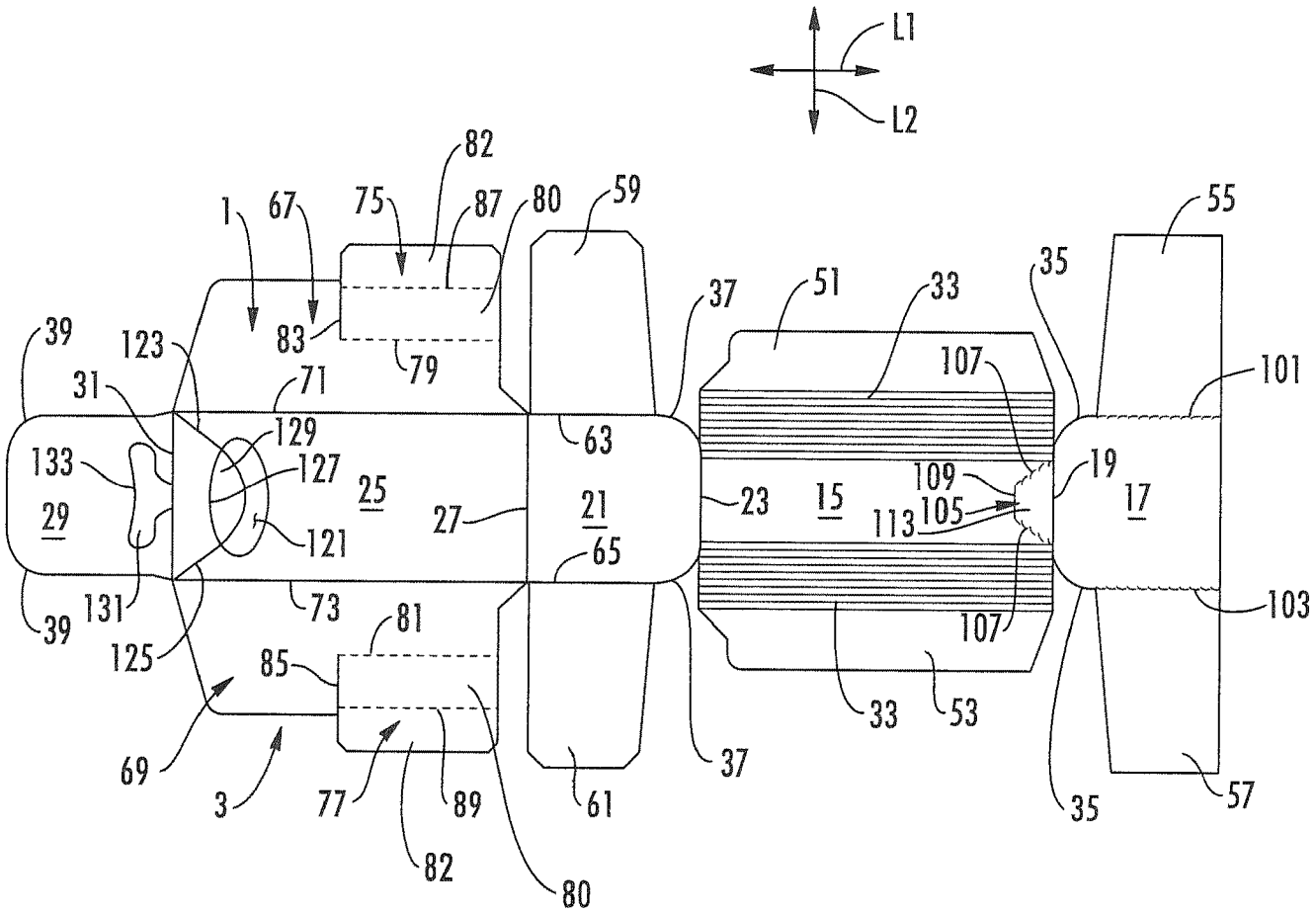
FIG. 1 is an exterior plan view of a blank used to form a carton according to an exemplary embodiment of the disclosure.
Figure 2:
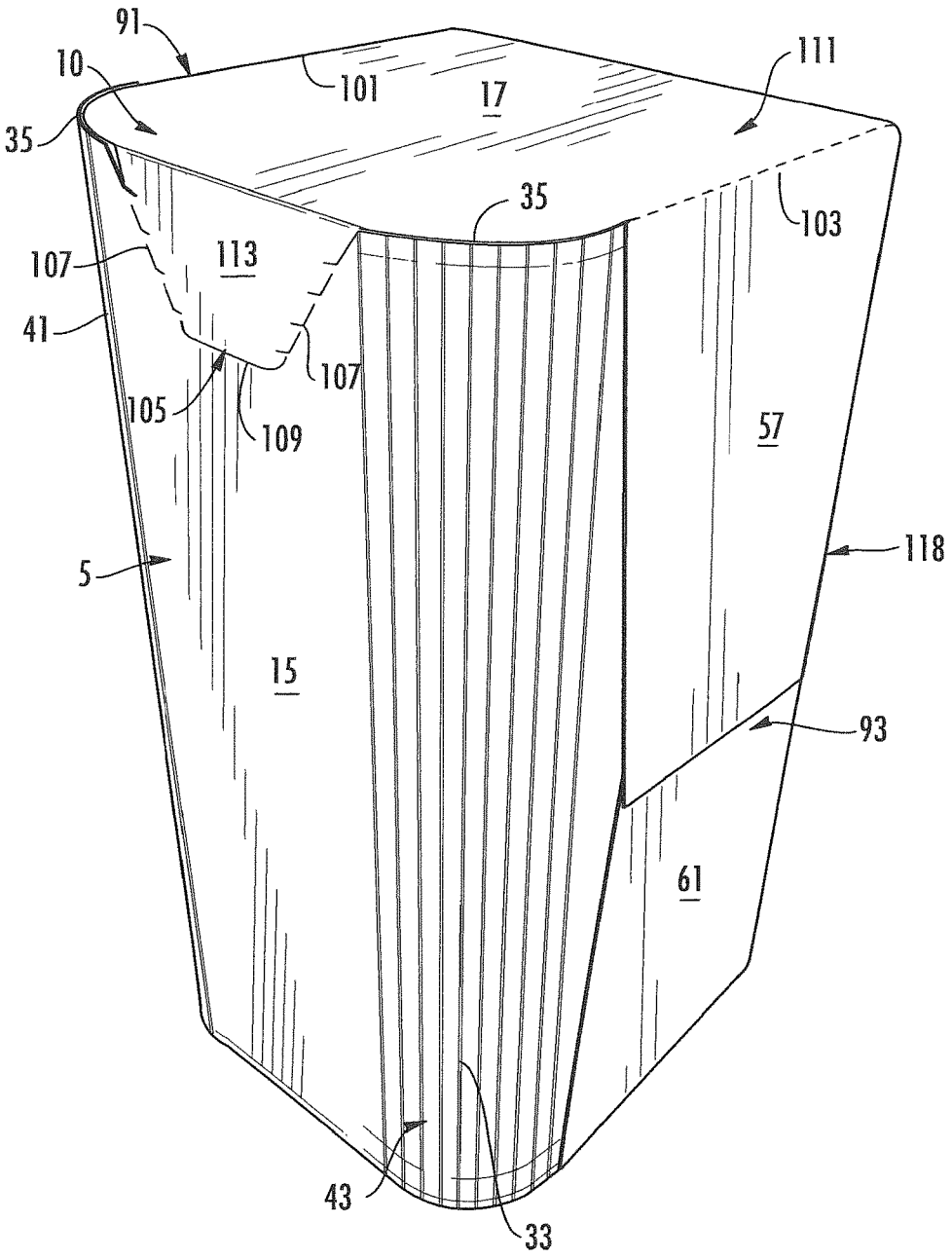
FIG. 2 is a front perspective view of a carton formed from the blank of FIG. 1 according to one embodiment of the disclosure.
Figure 3:
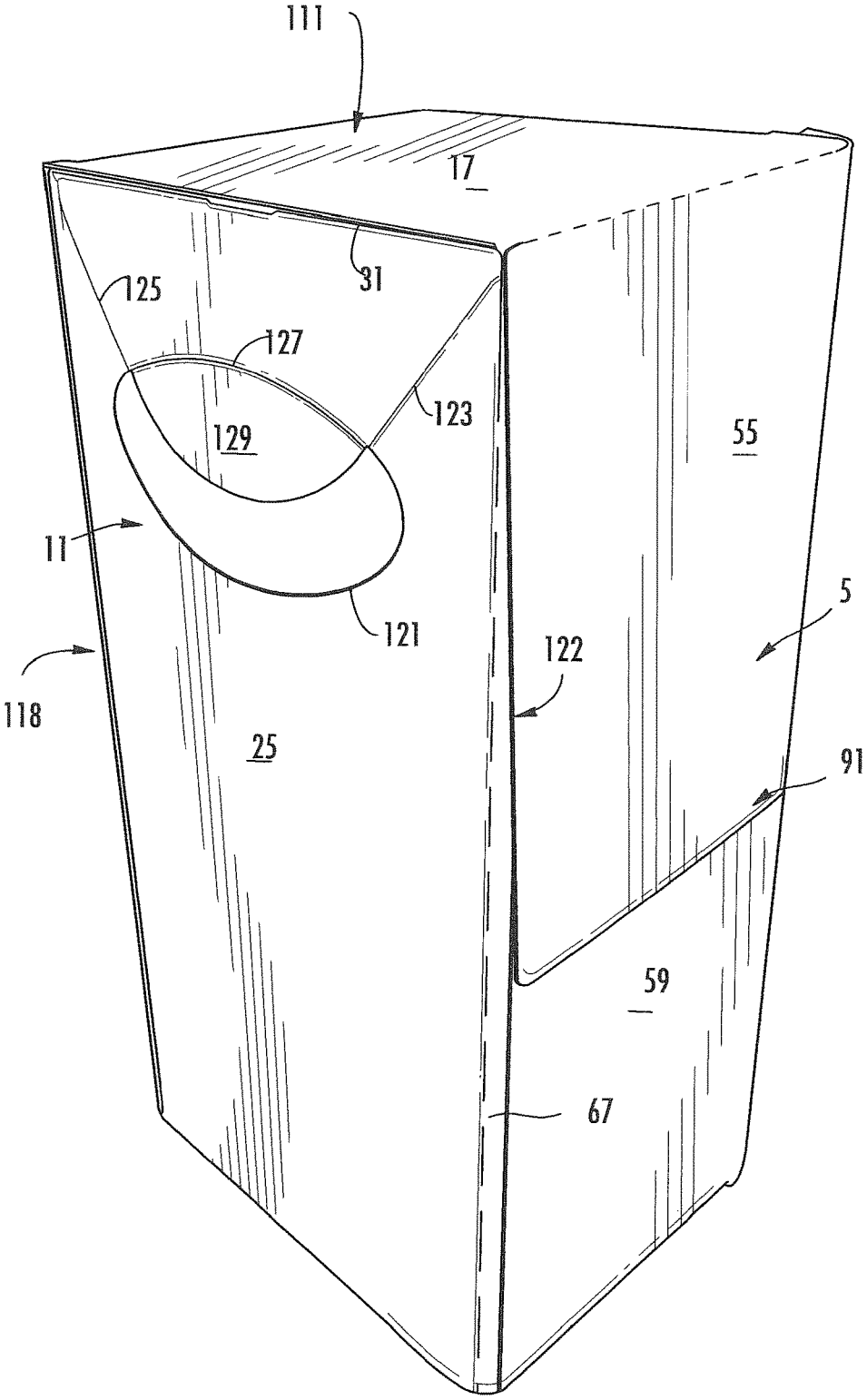
FIG. 3 is a back perspective view of the carton of FIG. 2.

FIG. 1 is a plan view of the exterior side 1 of a blank, generally indicated at 3, used to form a carton 5 (FIGS. 2-6) according to an exemplary embodiment of the disclosure. The carton 5 can be used to house a plurality of articles such as containers C (e.g., beverage bottles) with necks or upper portions N that are generally narrower than the lower portions of the containers. The containers C can include tops or caps CP. In the illustrated embodiment, the carton 5 is sized to house four containers C in a single layer in a 2×2 arrangement, but it is understood that the carton 5 may be sized and shaped to hold containers of a different or same quantity in more than one layer and/or in different row/column arrangements (e.g., 1×6, 3×6, 2×6×2, 3×5, 3×4, 4×5, 2×9, 2×6, 4×4, etc.). The carton 5 can include a dispenser 10 for allowing access to the containers C. In the illustrated embodiment, the carton 5 includes a handle 11 for grasping and carrying the carton.

The carton blank 3 has a longitudinal axis L1 and a lateral axis L2. In the illustrated embodiment, the blank 3 comprises a front panel 15 foldably connected to a first top panel 17 at a first lateral fold line 19. A bottom panel 21 is foldably connected to the front panel 15 at a second lateral fold line 23. A back panel 25 is foldably connected to the bottom panel 21 at a third lateral fold line 27. A second top panel 29 if foldably connected to the back panel 25 at a fourth lateral fold line 31. Any of the panels 15, 17, 21, 25, 29 can be otherwise shaped, arranged, or configured, without departing from the disclosure.

In one embodiment, the front panel 15 includes a plurality of longitudinal fold lines 33 at each edge margin of the front panel. The first top panel 17 includes curved edges 35, the bottom panel 21 includes curved edges 37, and the second top panel 29 includes curved edges 39. When the carton 5 is formed, the fold lines 33 allow the edge margins of the front panel 15 to curve and conform to the shape of curved edges 35, 37, 39 of the first top panel 17, bottom panel 21, and second top panel 29 to form respective curved corners 41, 43 (FIG. 6) of the carton 5. The blank 3 and carton 5 could have other features such as more than two curved corners 41, 43, or less than two curved corners without departing from the disclosure.

In the illustrated embodiment, end flaps 51, 53 are foldably connected to the front panel 15 at the outermost fold line 33 at each edge margin of the front panel, end flaps 55, 57 are foldably connected to the first top panel 17, end flaps 59, 61 are foldably connected to the bottom panel 21 at respective longitudinal fold lines 63, 65, and end flaps 67, 69 are foldably connected to the back panel 25 are respective longitudinal fold lines 71, 73. The end flaps 51, 55, 59, and 67 close a first end or side 91 of the carton 5 and the end flaps 53, 57, 61, 69 close a second end or side 93 of the carton. The blank 3 could have other end flap configurations without departing from the disclosure.

Figure 7:
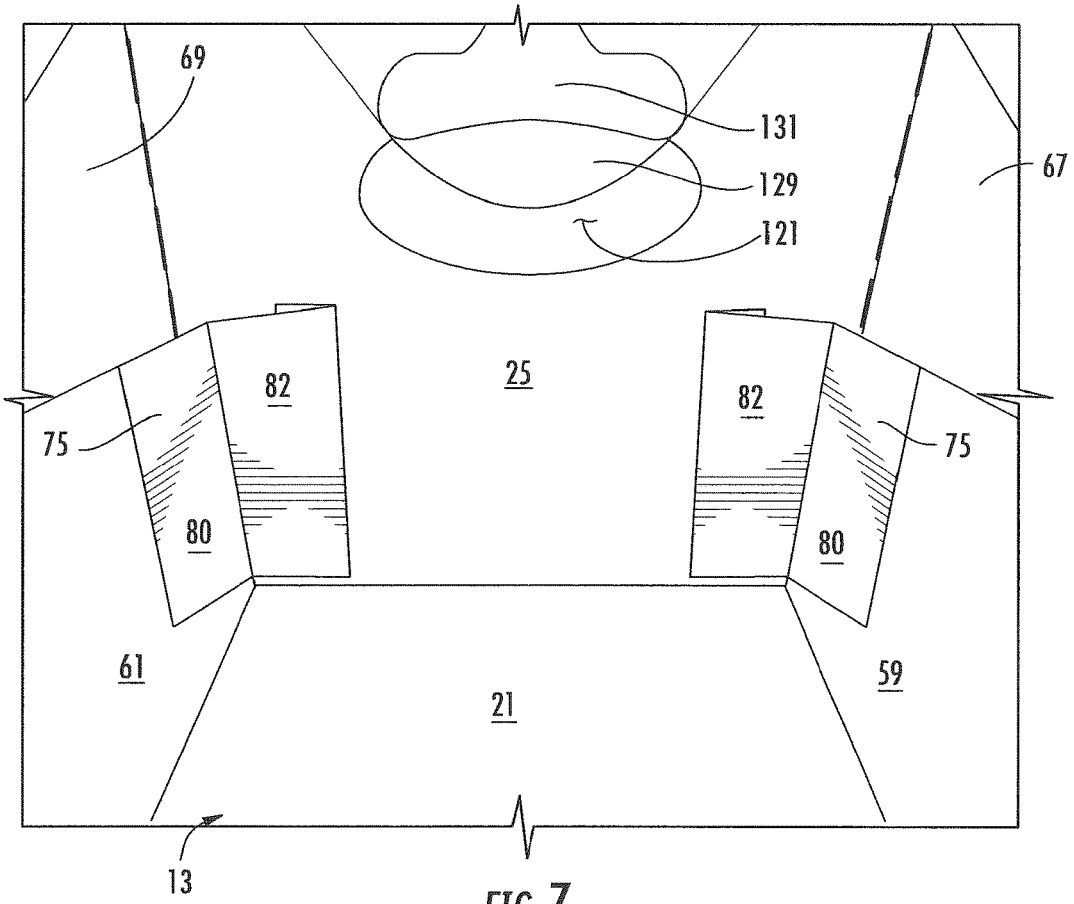
FIG. 7 is an interior view of the carton of FIG. 2.

In the illustrated embodiment, the end flaps 67, 69 include article support flaps or corner flaps 75, 77 foldably connected to a respective end flap 67, 69 at a longitudinal fold line 79, 81. The article support flaps help secure the containers C in the carton 5, help cushion the containers C, and/or help reinforce the respective back corners 118, 120 (FIG. 3) of the carton. Each article support flap 75, 77 is defined by a lateral cut 83, 85 in the respective end flap 67, 69 which can extend from an end of the longitudinal fold line 79, 81 to a longitudinal free edge of the respective side end flap. The article support flaps 75, 77 can comprise a generally longitudinal fold line 87, 89 extending across the respective article support flap 75, 77. The longitudinal fold line 87, 89 divides each article support flap 75, 77 into a base portion 80 and a distal portion 82 and allows the distal portion to be folded relative to the base portion to form the article support flap 75, 77. Accordingly, each of the article support flaps can be folded and positioned generally proximate or adjacent a respective corner 118, 120 of the carton 5 (FIG. 7) to at least partially conform to the shape of the containers C adjacent the corners and to help reduce the freedom of movement of the corner containers. The article support flaps 75, 77 could be otherwise shaped, arranged, and/or configured without departing from the disclosure.

In one embodiment, the blank 3 includes features for forming the dispenser 10. The dispenser features include a first longitudinal tear line 101 and second longitudinal tear line 103 in the first top panel 17. In one embodiment, the end flaps 55, 57 are foldably connected to the first top panel 17 by the respective tear lines 101, 103. The dispenser features include a tear line 105 in the front panel 15 that comprises two oblique portions 107 extending from the ends of fold line 19 and a lateral portion 109 connecting the oblique portions. The tear lines 101, 103, 105 define a dispenser panel 111 that includes the first top panel 17, a portion 113 of the front panel 15 defined by the tear line 105, and the second top panel 29 that is adhered to the first top panel 17 in the carton 5 formed from the blank 3. The blank 3 and/or carton 5 could have dispenser features that are otherwise shaped, arranged, and/or configured without departing from the disclosure.

As shown in FIG. 1, the blank 3 includes handle features for forming the handle 11 of the carton 5. The handle features include a handle opening 121 in the back panel 25, two oblique fold lines 123, 125 each generally extending from a respective end of the lateral fold line 31, a curved fold line 127 extending between the oblique fold lines, a handle flap 129 foldably connected to the back panel 25 at the curved fold line 127 and extending from the curved fold line into the handle opening 121, and a handle reinforcement flap 131 formed by a cut 133 in the second top panel 29. In the illustrated embodiment, the handle reinforcement flap 131 is foldably connected to the second top panel 29 and the back panel 25 at the portion of the lateral fold line 31 extending between the cut 133, but the handle features could be otherwise shaped, arranged, and/or configured. The blank 3 and/or carton 5 could have handle features that are otherwise shaped, arranged, and/or configured without departing from the disclosure.

In one exemplary embodiment, the carton 5 is formed from the blank 3 by positioning the panels 15, 17, 21, 25, 29 relative to each other and by folding along respective fold lines 19, 23, 27, 31 to form a bottom, front, back, and top of the carton. The second top panel 29 is folded inwardly so that the first top panel 17 overlaps and is adhered to the second top panel 29. The sides 91, 93 are closed by overlapping and adhering the end flaps 51, 55, 59, 67 at the first side 91 and the end flaps 53, 57, 61, 69 at the second side 93. At each side 91, 93, the end flaps 67, 69 connected to the back panel 25 are folded inwardly first and are overlapped by the end flaps 51, 53 connected to the front panel 15 and the end flaps 55, 57 connected to the first top panel 17 in succession. Prior to closing one or both sides 91, 93 of the carton, the article support flaps 75, 77 are formed in the interior 141 by folding the article support flaps along fold lines 79, 81 and positioning the support flaps generally face-to-face contact or approximate the end flaps 67, 69. The rounded corners 41, 43 are formed by positioning the edge margins of the front panel 15 that include the fold lines 33 in a curved configuration so that each of the edge margins of the front panel conforms to the shape of the curved edges 35, 37, 39 of the first top panel 17, bottom panel 21, and second top panel 29. Prior to closing the top of the carton 5, containers C are placed in the carton with at least a portion of the two front containers (i.e., the containers adjacent the front panel 15) being in secure supporting contact with the rounded corners 41, 43 and at least a portion of the two back containers (i.e., the containers adjacent the back panel 25) being in secure supporting contact with the article support flaps 75, 77. The carton 5 can be formed and/or loaded with containers in alternative methods that can include different or alternative steps without departing from the disclosure.

In one embodiment, the handle 11 can be formed prior to closing one or both sides 91, 93 by downwardly folding the handle reinforcement flap 131 and adhering the handle reinforcement flap to the back panel 25 just above the handle flap 129. The handle reinforcement flap 131 may be secured to the back panel 25 prior to the second top panel 29 being secured to the first top panel 17. The handle reinforcement flap 131 has a curved edge 151 that overlaps and conforms to the curved fold line 127 in the back panel 25. When the handle 11 is grasped, the handle flap 129 can be upwardly folded along fold line 127 and can be positioned in face-to-face contact with the handle reinforcement flap 131 in the interior 141 of the carton 5 so that the carton 5 includes three layers of material above the handle opening 121 (e.g., the upwardly folded handle flap 129, the handle reinforcement flap 131, and the portion of the back panel 25 above the handle opening 121). In this way, the handle 11 is reinforced and strengthened to prevent tearing of the carton 5 upon grasping and lifting at the handle. The handle 11 could be formed by other methods or forming steps without departing from the disclosure.

Figure 4:
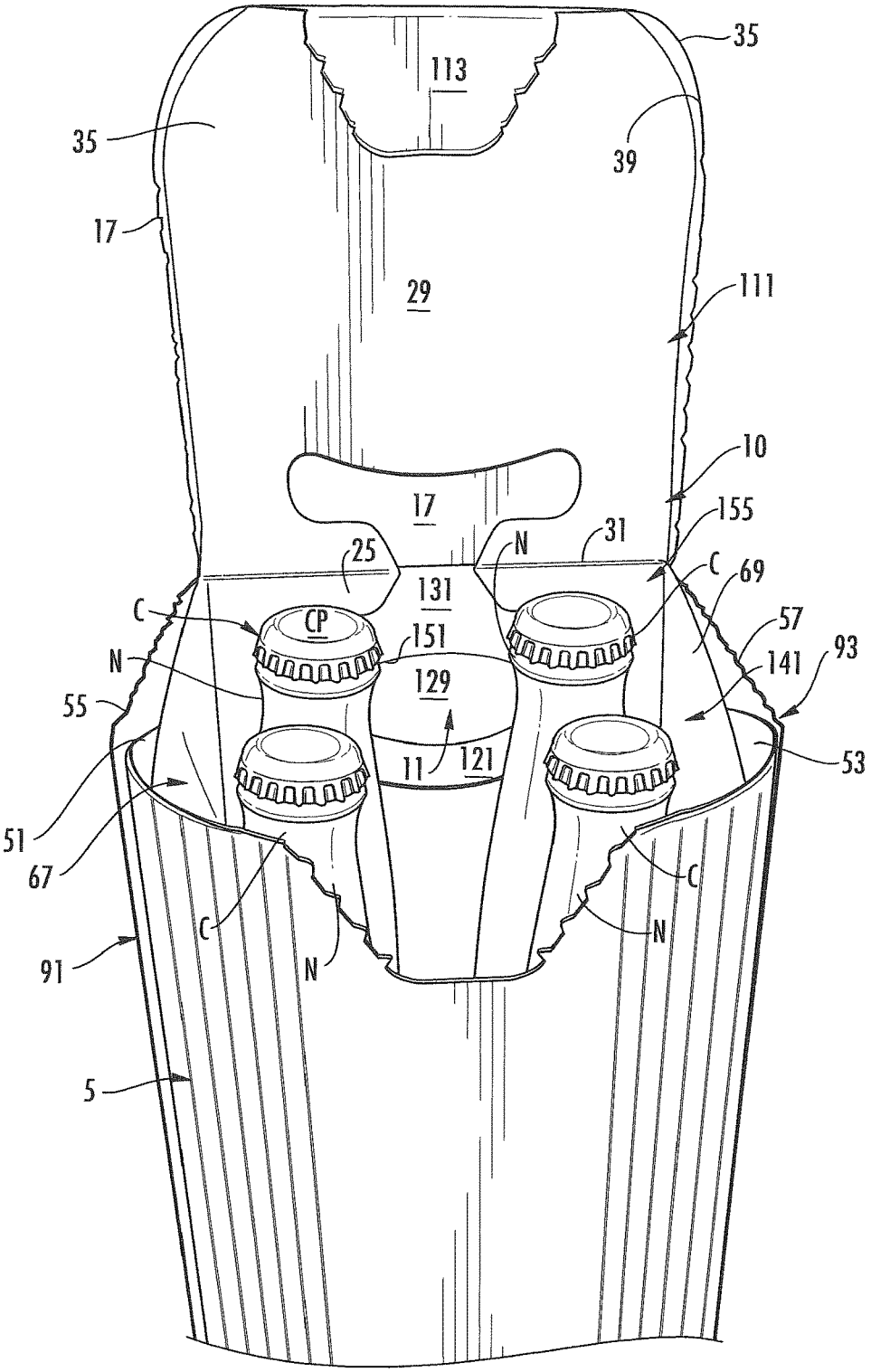
FIG. 4 is a perspective view of the carton of FIG. 2 in the open configuration.
Figure 5:
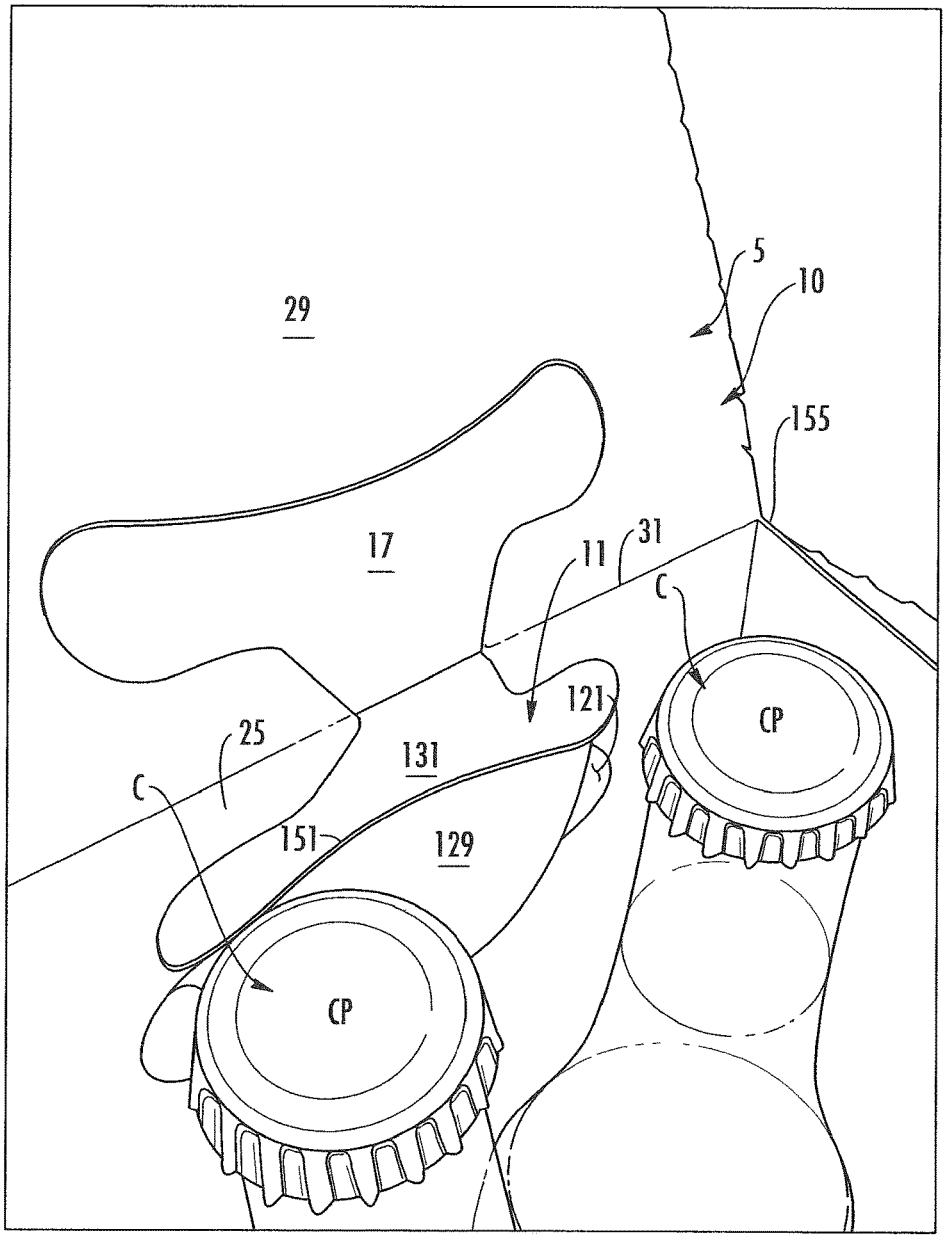
FIG. 5 is a view of the interior of the carton of FIG. 2.
Figure 6:
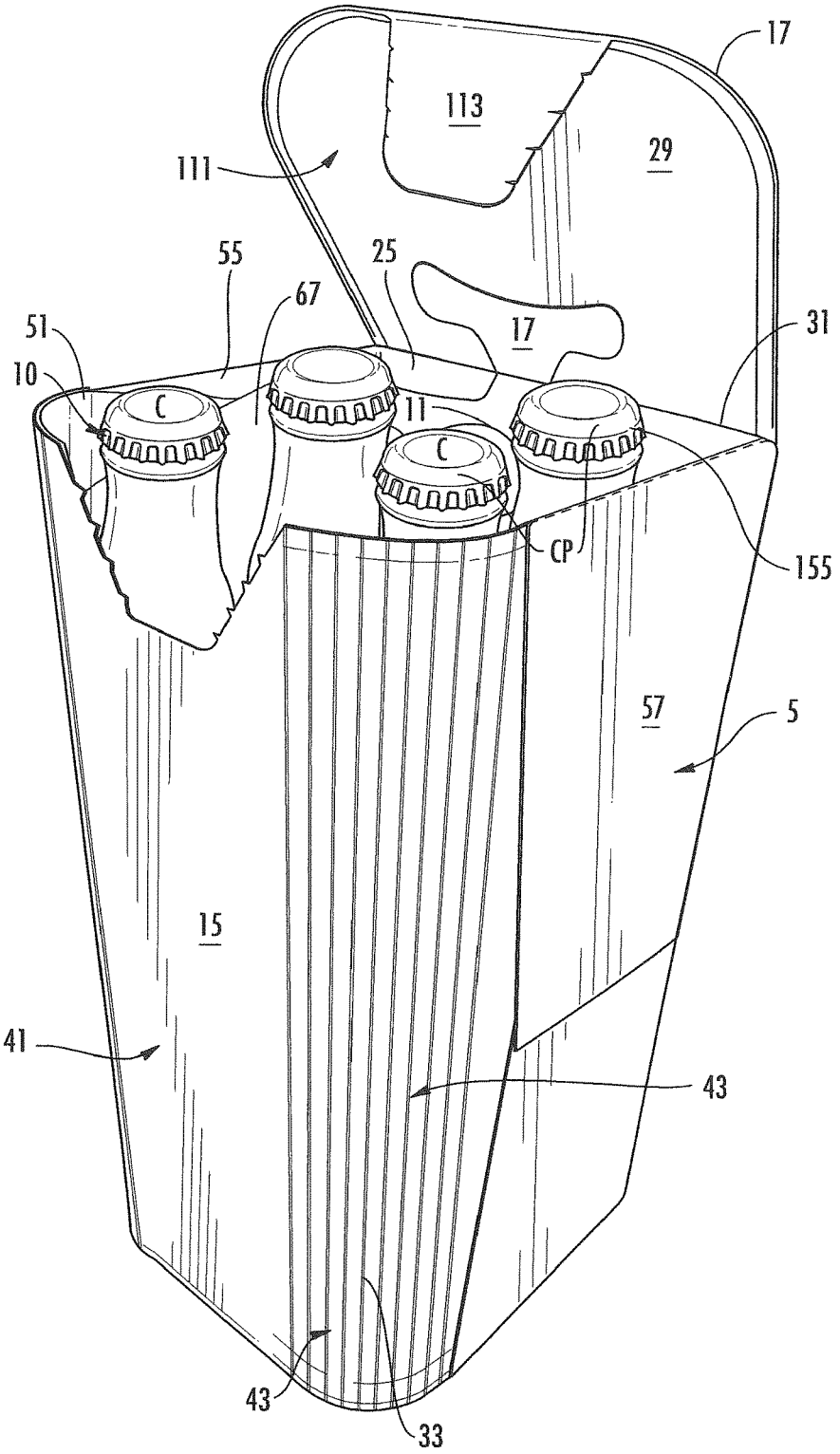
FIG. 6 is a perspective view of the carton in the open configuration.

The dispenser 10 can be activated to access the containers C by tearing along tear lines 101, 103, 105 to at least partially separate the dispenser panel 111 from the remainder of the carton 5. As shown in FIGS. 4-6, the dispenser panel 111 can be lifted and pivoted about fold line 31 to create a dispenser opening 155 in the top of the carton 5. One or more of the containers C can be removed from the carton 5 through the dispenser opening 155. The dispenser 10 and dispenser panel 111 could be otherwise shaped, arranged, and/or configured without departing from the disclosure. In an alternative embodiment, the dispenser panel 111 could be removed from the carton without departing from the disclosure. Also, the dispenser panel 111 and/or the dispenser 10 could be alternatively shaped to allow access to the containers C through other than the top of the carton 5 without departing from the disclosure.

The carton 5 is configured to provide secured packaging of the four containers C in the interior 141 by the configuration of the rounded corners 41, 43 and the article support flaps 75, 77 in the interior 141 of the carton. In this way, all four containers C are held in a tight engagement to reduce movement of the containers and possible breakage. The carton 5 could have other features to prevent breakage of the containers without departing from the disclosure. Further, the handle 11 is reinforced and located in the back panel 25 to allow the carton 5 to be easily carried without tearing during lifting of the carton. The dispenser 10 is configured to allow quick and convenient access to the containers C through the top of the carton 5 without compromising the integrity of the handle 11. Also, the opened carton 5 can continue to be carried at the handle 11 after removing one or more of the containers though the dispenser 10.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a front panel, a back panel, a bottom panel, and at least one top panel;

a plurality of end flaps each respectively foldably connected to a respective panel of the plurality of panels for at least partially closing an end of the carton; and a handle comprising a handle opening in the back panel, a handle flap foldably connected to the back panel at a curved fold line and adjacent the handle opening, and a handle reinforcement flap foldably connected to the at least one top panel and defined by a cut line in the at least one top panel, wherein the handle comprises two oblique fold lines in the back panel extending from the curved fold line to the fold line connecting the back panel and the at least one top panel.

2. A carton for holding a plurality of containers, the carton comprising:

a plurality of panels that extends at least partially around an interior of the carton, the plurality of panels comprises a front panel, a back panel, a bottom panel, and at least one top panel, wherein the front panel comprises a first edge margin and a second edge margin, a first plurality of fold lines extend across the first edge margin, and a second plurality of fold lines extend across the second edge margin, and wherein the at least one top panel comprises a first top curved edge and a second top curved edge and the bottom panel comprises a first bottom curved edge and a second bottom curved edge, the carton comprises a first curved corner comprising the first edge margin that is curved to confirm to the first top curved edge and the first bottom curved edge and a second curved corner comprising the second edge margin that is curved to conform to the second top curved edge and the second bottom curved edge;

a plurality of end flaps each respectively foldably connected to a respective panel of the plurality of panels for at least partially closing an end of the carton; and a handle comprising a handle opening in at least one of the front panel and the back panel, and a handle reinforcement flap foldably connected to the at least one top panel.

3. The carton of claim 2, wherein the handle opening is in the back panel, the handle comprises a handle flap foldably connected to the back panel at a curved fold line and adjacent the handle opening, and the handle reinforcement flap is defined by a cut line in the at least one top panel.

4. The carton of claim 2, wherein the handle opening is in the back panel, the handle comprises a handle flap foldably connected to the back panel at a curved fold line and adjacent the handle opening, and the handle reinforcement flap is in face-to-face contact with the back panel above the handle flap.

5. The carton of claim 3, wherein the back panel is foldably connected to the at least one top panel at a fold line and the handle reinforcement flap is foldably connected to the at least one top panel at the fold line.

6. The carton of claim 3, wherein the at least one top panel is a second top panel and the plurality of panels comprises a first top panel that overlaps the second top panel to form the top of the carton.

7. The carton of claim 2, further comprising a dispenser comprising a dispenser panel comprising at least a portion of a panel of the plurality of panels.

8. The carton of claim 7, wherein the dispenser panel comprises at least a portion of the front panel and the at least one top panel.

9. The carton of claim 8, wherein the dispenser panel is defined by a plurality of tear lines in the at least one top panel and the front panel.

10. The carton of claim 9, wherein the at least one top panel comprises a first top panel foldably connected to the front panel at a first fold line and a second top panel foldably connected to the back panel and the handle reinforcement flap.

11. The carton of claim 10, wherein the plurality of tear lines comprise a first tear line and a second tear line in the first top panel and a third tear line in the front panel, the dispenser panel comprises the second top panel adhered to the first top panel.

12. The carton of claim 2, wherein at least one of the plurality of end flaps comprises an article support flap foldably connected to at least one end flap, the article support flap is defined by a lateral cut extending at least partially across the at least one end flap.

13. The carton of claim 12, wherein the article support flap comprises a longitudinal fold line dividing the article support flap into a base portion and a distal portion, the distal portion is folded relative to the first base portion to form the article support flap.

14. A blank for forming a carton for holding a plurality of containers, the blank comprising:

a plurality of panels comprising a front panel, a back panel, a bottom panel, and at least one top panel;

a plurality of end flaps each respectively foldably connected to a respective panel of the plurality of panels for at least partially closing an end of the carton formed from the blank; and handle features for forming a handle, the handle features comprising a handle opening in the back panel, a handle flap foldably connected to the back panel at a curved fold line and adjacent the handle opening, and a handle reinforcement flap foldably connected to the at least one top panel and defined by a cut line in the at least one top panel, wherein the handle features comprises two oblique fold lines in the back panel extending from the curved fold line to the fold line connecting the back panel and the at least one top panel.

15. A blank for forming a carton for holding a plurality of containers, the blank comprising:

a plurality of panels comprising a front panel, a back panel, a bottom panel, and at least one top panel, wherein the front panel comprises a first edge margin and a second edge margin, a first plurality of fold lines extend across the first edge margin, and a second plurality of fold lines extend across the second edge margin, and wherein the at least one top panel comprises a first top curved edge and a second top curved edge and the bottom panel comprises a first bottom curved edge and a second bottom curved edge;

a plurality of end flaps each respectively foldably connected to a respective panel of the plurality of panels for at least partially closing an end of the carton formed from the blank; and handle features for forming a handle, the handle features comprising a handle opening in at least one of the front panel and the back panel and a handle reinforcement flap foldably connected to the at least one top panel.

16. The blank of claim 15, wherein the handle opening is in the back panel, the handle comprises a handle flap foldably connected to the back panel at a curved fold line and adjacent the handle opening, and the handle reinforcement flap is defined by a cut line in the at least one top panel.

17. The blank of claim 15, wherein the handle opening is in the back panel, the handle comprises a handle flap foldably connected to the back panel at a curved fold line and adjacent the handle opening, and the handle reinforcement flap is configured to be in face-to-face contact with the back panel above the handle flap when the carton is formed from the blank.

18. The blank of claim 16, wherein the back panel is foldably connected to the at least one top panel at a fold line and the handle reinforcement flap is foldably connected to the at least one top panel at the fold line.

19. The blank of claim 16, wherein the at least one top panel is a second top panel and the plurality of panels comprises a first top panel that overlaps the second top panel to form the top of the carton formed from the blank.

20. The blank of claim 15, further comprising dispenser features comprising a dispenser panel comprising at least a portion of a panel of the plurality of panels.

21. The blank of claim 20, wherein the dispenser panel comprises at least a portion of the front panel and the at least one top panel.

22. The blank of claim 21, wherein the dispenser panel is defined by a plurality of tear lines in the at least one top panel and the front panel.

23. The blank of claim 22, wherein the at least one top panel comprises a first top panel foldably connected to the front panel at a first fold line and a second top panel foldably connected to the back panel and the handle reinforcement flap.

24. The blank of claim 23, wherein the plurality of tear lines comprise a first tear line and a second tear line in the first top panel and a third tear line in the front panel, the dispenser panel comprises the second top panel adhered to the first top panel.

25. The blank of claim 15, wherein at least one of the plurality of end flaps comprises an article support flap foldably connected to at least one end flap, the article support flap is defined by a lateral cut extending at least partially across the at least one end flap.

26. The blank of claim 25, wherein the article support flap comprises a longitudinal fold line dividing the article support flap into a base portion and a distal portion, the distal portion is folded relative to the first base portion to form the article support flap.

27. A method of forming the carton comprising:

obtaining a blank comprising a plurality of panels comprising a front panel, a back panel, a bottom panel, and at least one top panel, a plurality of end flaps each respectively foldably connected to a respective panel of the plurality of panels, and handle features comprising a handle opening in the back panel, a handle flap foldably connected to the back panel at a curved fold line, and a handle reinforcement flap foldably connected to the at least one top panel and defined by a cut line in the at least one top panel;

forming an interior of the carton by positioning the plurality of panels;

inserting a plurality of containers into the interior of the carton;

at least partially overlapping the plurality of end flaps to at least partially form a closed end of the carton; and forming a handle in the back panel from the handle features by folding the handle reinforcement flap into face-to-face contact with the back panel above the handle flap to reinforce and strengthen the handle to prevent tearing of the carton when force is applied to the handle, wherein the handle comprises two oblique fold lines in the back panel extending from the curved fold line to the fold line connecting the back panel and the at least one top panel.

28. The method of claim 27, wherein the handle reinforcement flap has a curved edge that conforms to the shape of the curved fold line.

29. The method of claim 27, wherein the back panel is foldably connected to the at least one top panel at a fold line and the handle reinforcement flap is foldably connected to the at least one top panel at the fold line.

30. The method of claim 27, wherein the at least one top panel is a second top panel and the plurality of panels comprises a first top panel, the method further comprises overlapping the first top panel with the second top panel to form the top of the carton.

31. A method of forming the carton comprising:

obtaining a blank comprising a plurality of panels comprising a front panel, a back panel, a bottom panel, and at least one top panel, a plurality of end flaps each respectively foldably connected to a respective panel of the plurality of panels, and handle features comprising a handle opening in the back panel and a handle reinforcement flap foldably connected to the at least one top panel, wherein the front panel comprises a first edge margin and a second edge margin, a first plurality of fold lines extend across the first edge margin, and a second plurality of fold lines extending across the second edge margin, the at least one top panel comprises a first top curved edge and a second top curved edge, the bottom panel comprises a first bottom curved edge and a second bottom curved edge;

forming an interior of the carton by positioning the plurality of panels;

inserting a plurality of containers into the interior of the carton;

at least partially overlapping the plurality of end flaps to at least partially form a closed end of the carton;

forming a handle in the back panel from the handle features by folding the handle reinforcement flap into face-to-face contact with the back panel above the handle flap to reinforce and strengthen the handle to prevent tearing of the carton when force is applied to the handle;

forming a first curved corner of the carton by positioning the first edge margin to confirm to the first top curved edge and the first bottom curved edge, and forming a second curved corner of the carton by positioning the second edge margin to conform to the second top curved edge and the second bottom curved edge.

* * * * *